US007137697B2

(12) United States Patent
Lehmann

(10) Patent No.: US 7,137,697 B2
(45) Date of Patent: Nov. 21, 2006

(54) METHOD OF PRINTING AND CORRESPONDING PRINT MACHINE

(75) Inventor: Udo Lehmann, Bickenbach (DE)

(73) Assignee: Aurentum Innovationstechnologien GmbH, Mainz (DE)

( * ) Notice: Subject to any disclaimer, the term of this patent is extended or adjusted under 35 U.S.C. 154(b) by 100 days.

(21) Appl. No.: 10/240,301

(22) PCT Filed: Mar. 28, 2001

(86) PCT No.: PCT/DE01/01201

§ 371 (c)(1),
(2), (4) Date: Feb. 11, 2003

(87) PCT Pub. No.: WO01/72518

PCT Pub. Date: Oct. 4, 2001

(65) Prior Publication Data

US 2003/0156178 A1 Aug. 21, 2003

(30) Foreign Application Priority Data

Mar. 30, 2000 (DE) ..... 100 15 786
Oct. 19, 2000 (DE) ..... 100 51 850

(51) Int. Cl.
*B41J 2/01* (2006.01)

(52) U.S. Cl. ..... 347/103

(58) Field of Classification Search ..... 347/224, 347/225, 235, 243, 244, 259, 51–52, 66, 347/49, 61, 101–107, 20; 101/170
See application file for complete search history.

(56) References Cited

U.S. PATENT DOCUMENTS

| | | | | |
|---|---|---|---|---|
| 3,980,018 | A * | 9/1976 | Ichikawa | 101/170 |
| 4,369,451 | A * | 1/1983 | Sekido et al. | 347/225 |
| 5,021,808 | A * | 6/1991 | Kohyama | 347/66 |
| 5,854,175 | A | 12/1998 | DeBoer | 503/227 |
| 6,056,388 | A * | 5/2000 | Maximovsky et al. | 347/51 |
| 6,241,344 | B1 * | 6/2001 | Machida | 347/66 |

FOREIGN PATENT DOCUMENTS

| | | |
|---|---|---|
| EP | 0605334 | 7/1994 |
| EP | 0671239 | 9/1995 |
| JP | 10193572 A * | 7/1998 |
| WO | WO 00/12317 | 3/2000 |

* cited by examiner

*Primary Examiner*—Hai Pham
(74) *Attorney, Agent, or Firm*—Michael L. Dunn

(57) ABSTRACT

A printing process for the transfer of printing substance (8) from an ink carrier (2) onto an imprinting material, in which the printing substance (8) undergoes a change in volume and/or position by means of an induced procedure of an energy-releasing apparatus, and thereby a transfer of a printing point onto the imprinting material takes place. The invention further includes a printing machine suitable for practicing the process.

33 Claims, 10 Drawing Sheets

METHOD OF PRINTING AND CORRESPONDING PRINT MACHINE

BACKGROUND OF THE INVENTION

The present invention relates to a printing process for the transfer of printing substance from an ink carrier onto an imprinting material, the printing substance undergoing a change in volume and/or position by means of an induced procedure of an energy-releasing apparatus, and thereby a transfer of a printing point onto the imprinting material takes place, as well as a printing machine for this.

By a printing process is meant primarily a process for the reproduction as often as required of text and/or image patterns by means of a printing plate which is re-inked after each impression. In general, a distinction is made here between four basically different printing processes. Firstly, the relief printing process is known, in which the printing elements of the printing plate are raised, while the non-printing parts are recessed. This includes for example letterpress printing and so-called flexographic or aniline printing. Furthermore, flatbed-printing processes are known in which the printing elements and the non-printing parts of the printing plate essentially lie in one level. These include offset printing, but also processes known more in the artistic field, such as e.g. lithographic printing. In the case of offset printing, strictly speaking the inked drawing on the printing plate is not printed directly onto the imprinting material, but is first transferred onto a rubber cylinder or a rubber blanket and only then is the imprinting material printed from this. Where in the following reference is made to imprinting material, however, this is to be understood as both the actual imprinting material, i.e. the material to be printed on, and a chosen transfer means, such as e.g. a rubber cylinder. A third process is the so-called gravure printing process in which the printing elements of the printing plate are recessed. This includes a series of manual techniques, such as e.g. copper engraving and etching. A gravure printing process used industrially is rotogravure printing. Finally, a porous printing process is also known which is sometimes also called the screen-printing process, in which at the printing positions the ink is transferred onto the imprinting material through screen-like openings of the printing plate.

These printing processes are all characterized by the fact that they require a printing plate which is more or less costly to produce, with the result that these printing processes operate economically only with very long print runs, usually well over 1000 units. Thus for example when producing a relief printing plate, a screen film of the pattern to be printed must initially be created which is copied onto the material of the printing plate by means of a light-sensitive layer. As the non-printing parts of a relief printing plate must be recessed relative to the printing parts, the metal printing plates are then etched or plastic printing plates are washed out. However, these printing plates can be used only for the printing of a specific pattern. If another pattern is to be printed, a new relief printing plate must be produced.

For the printing of short print runs, printers are already used which in general are connected to an electronic data processing system. In general, these use digitally triggerable printing systems which are in a position to print individual printing points as required. Such printing systems use various processes with different printing substances on different imprinting materials. Some examples of digitally triggerable printing systems are: laser printers, thermal printers and ink jet printers. Digital printing processes are characterized by the fact that they do not require printing plates.

An electro-thermal ink jet printing process is known for example from GB 2 007 162, in which the water-based ink is briefly heated in a suitable ink jet by electrical pulses until it boils, with the result that a gas bubble suddenly develops and an ink droplet is shot out of the jet. This process is generally known by the term "bubblejet". However, these thermal ink printing processes have the disadvantage that on the one hand they consume a great deal of energy for the printing of an individual printing point and on the other hand they are suitable only for printing inks which are water-based. Furthermore, every single printing point must be triggered separately by the jet. In contrast, piezoelectric ink printing processes suffer from the disadvantage that the required jets are easily blocked, with the result that only special and expensive inks can be used for this.

In addition, it is known from DE 195 44 099 that with the help of a laser beam or electro-thermal heating means, solid printing substances can be melted and thereby transferred. A transparent cylinder is homogeneously provided with small cells on the surface. These cells are then filled with molten liquid ink and wiped using customary processes. The ink to be printed is then melted in a targeted manner from the inside through the cylinder by firing a laser beam or by electro-thermal processes and is thus drained and thereby a printing point is set. Also in this process, the choice of printing substance is very limited because it is necessary for the printing process that the printing substance shows a phase transition from the solid into the liquid phase as quickly as possible and in an energy-saving manner. Furthermore, in this printing process the filling of the cells with meltable ink is problematic.

Finally, it is known from DE 197 46 174 that a laser beam, through very short pulses in a printing substance which is located in cells of a printing roller, induces a procedure with the result that the printing substance undergoes a change in volume and/or position. The printing substance thereby spreads over the surface of the printing plate and it is possible to transfer a printing point onto an imprinting material moved up against same. However, in this process it is disadvantageous that the filling of the cells is very difficult due to the small diameter of the cells.

BRIEF SUMMARY OF THE INVENTION

The object of the present invention is therefore to provide a printing process and a printing machine which can be operated with very little energy, allow an easy refilling of the printing substance and additionally overcome the above-mentioned disadvantages.

In accordance with the invention a printing process is provided for the transfer of printing substance (8) from an ink carrier (2) onto an imprinting material or a transfer means, in which the printing substance (8) undergoes a change in volume and/or position by means of an induced procedure of an energy-releasing apparatus, and so that a transfer of a printing point onto the imprinting material or the transfer means takes place.

The invention also includes a printing machine for the imprinting of an imprinting material with an ink carrier (2) and an energy-releasing apparatus, which is arranged such that energy can be transferred in a targeted manner onto specific areas of the ink carrier (2). The ink carrier (2) is provided in order to receive printing substance (8) essentially forming a continuous film.

DETAILED DESCRIPTION OF THE INVENTION

Figure 1A:
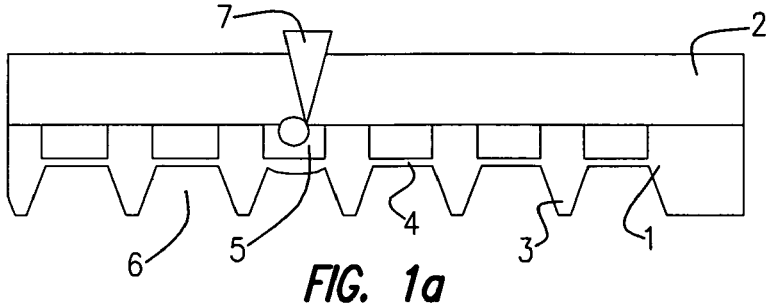
FIGS. 1*a*) and 1*b*) show a schematic sectional views of a section cut through the ink carrier including printing plate, FIGS. 2*a*) to 2*d*) show schematic representations of the printing process for various versions, FIGS. 3*a*) and 3*b*) show sectional views of two alternative versions of apparatus of the invention, FIGS. 4*a*) to 4*c*) show various versions of a printing mechanism of the invention, FIGS. 5*a*) and 5*b*) show sectional views of alternative versions of the invention.

As previously discussed, the object of the present invention is to provide a printing process and a printing machine which can be operated with very little energy, allow an easy refilling of the printing substance and additionally overcome the above-mentioned disadvantages.

According to the invention, this object is achieved with regard to the process in that the printing substance is applied to the ink carrier, essentially forming a homogeneous film. The fact that the printing substance forms a homogeneous film ensures that, as a result of the adhesion or the capillary force between the printing substance, the ink carrier and if necessary the printing plate, a simple filling of any cell or opening is achieved. This is clearly due to the fact that, among other things, no air inclusions form when the printing substance is fed onto the ink carrier.

There is used as an ink carrier for example a cylindrical body which preferably rotates about its own axis. The imprinting material, e.g. paper, plastic film, metal foil, but also bend-resistant materials such as glass or metal, is advantageously moved past this ink carrier at a transport speed which roughly corresponds to the circumferential speed of the cylindrical body. However, it is self-evident that the circumferential speed of the cylindrical body can also be greater than the rate of advance of the imprinting material.

The ink carrier is preferably light-permeable in order that the energy-releasing apparatus can release energy for example in the form of light from the side of the ink carrier facing away from the printing substance through the ink carrier directly into the printing substance.

The energy-releasing apparatus is preferably a laser beam-emitting apparatus, the laser beam preferably being focused on a selected point on the ink carrier. The light-permeable transparent cylinder could have for example recesses in the form of cells, in order that by focusing the laser beam of the energy-releasing apparatus onto a specific cell, a change in position and/or volume of the printing substance takes place in the cell concerned, with the result that the printing substance here extends over the external perimeter of the transparent ink carrier and a transfer of the printing substance onto the imprinting material can take place.

Alternatively, a preferably light-permeable transfer cylinder can also advantageously be provided, which is moved up against the ink carrier at one section and comes into contact with the actual imprinting material at another section. With the help of a laser beam-emitting apparatus arranged inside the transfer cylinder, a laser beam can then be focused through the light-permeable transfer cylinder onto a selected point on the ink carrier. The printing substance thereby undergoes a change in position and/or volume and a transfer of printing substance from the ink carrier onto the transfer cylinder takes place. If the transfer cylinder is now rotated, the printing substance carried on the transfer cylinder is at some point brought into contact with the actual imprinting material and transferred to this.

In the version with cells, the imprinting material can, but need not, touch the ink carrier during the transfer of the printing point. Rather, it is sufficient if the imprinting material is brought towards the ink carrier at least to the point where, through the inducing of a change in position or volume of the printing substance, this can move in the direction of the imprinting material until a transfer of ink takes place.

The energy can be transferred directly into the printing substance. However, this assumes that the printing substance is in a position to absorb the energy. In order to increase the variety of usable printing substances, it is therefore advantageous if the energy from the energy-releasing apparatus is initially transferred into an exchange material and then from the exchange material onto the printing substance. The exchange material is preferably a light-absorbing material which is arranged advantageously in the form of a layer on the ink carrier. The energy transfer from the exchange material onto the printing substance can take place for example by transferring heat energy. This means that, through the energy-releasing apparatus, at the relevant desired location the exchange material is initially heated, which in turn releases heat energy to the printing substance. However, it is also possible that the energy transfer takes place via a pulse transfer. This means that here a change in position and/or volume of the material is induced inside the exchange material, with the result that through the movement or expansion of the exchange material, a pulse is transferred onto the printing substance. In the case of this indirect printing process, the energy-absorbing layer is preferably geared to the absorption of the energy beam as optimally as possible, in order that the energy to be used for the transfer of a printing point can be further reduced.

It is to be emphasized at this point that a printing plate in the standard sense is not absolutely necessary for the process according to the invention. It is possible to provide the cylindrical ink carrier with recesses forming a printing plate, the so-called cells, which are applied essentially to the outer surface of the ink carrier, but which are connected to each other, with the result that the printing substance, which is located in neighbouring recesses, has a connection. However, it is also possible to dispense entirely with specific plate elements. For example, it is thus possible to design the cylindrical ink carrier without recesses. By releasing a focused laser beam onto a selected location, a local change in volume and/or position of the printing substance is induced here, with the result that an ink droplet is locally detached from the essentially homogeneous ink layer. The detachment does not have to take place solely due to the induced energy, rather, if the imprinting material is moved up close enough against the printing substance, it is quite sufficient if a change in position of the printing substance takes place due to the induced energy, with the result that due to the local raising of the printing substance, this touches the imprinting material and the detachment thereby results.

The "printing plate" is virtually formed from the surrounding printing substance as a result of the inertia of the remaining printing substance.

The thickness of the printing point can preferably be set here via the variation of the laser energy and/or via the variation of the pulse length.

Alternatively or in combination with this, it is possible that the diameter of the printing point is set via the variation of the laser energy and/or via the variation of the pulse length.

The resolution of the printing process can therefore be set almost as desired. In addition, the positioning of the printing point can be freely chosen. In contrast to this, in the case of the known process only defined positions, namely the positions of the cells, are available. Even if, in the case of a good resolution, the number of cells on the ink carrier can easily amount to more than 100 million, the framework of points and the size of the points are pre-specified by such an ink carrier. If such form-giving elements are entirely dispensed with, there is preferably maintained between the ink carrier and the imprinting material or the printing substance on the ink carrier and the imprinting material a distance which preferably amounts to at least 10 μm, particularly preferably roughly 50 μm. In contrast to the known processes here, the imprinting material does not touch the "printing plate" or the ink carrier. This has the advantage that expensive wiping devices are not required.

The pulse length of the used laser pulse is advantageously less than 1 μs, preferably less than 500 ns, particularly preferably between 100 and 200 ns. Due to the very short pulse length (if there is sufficient total energy), the laser energy is locally limited very well and a clean printing of printing points is thus achieved, without the capillary forces of the printing substance forming a continuous film manifesting themselves negatively. Advantageously, laser pulses with a pulse duration of a few femtoseconds are even already used.

In the described printing process, a laser beam is focused onto an ink carrier or into the printing substance. If the laser light is absorbed, heat is generated in the printing substance, as a result of which the solvent evaporates almost at once and some of the printing substance is thrown from the ink carrier. In order that the process works optimally, care must be taken that the energy from the laser beam is transferred rapidly into the printing substance and at the precise point. This energy transfer can either take place by using printing inks which are non-absorbent for the laser beam, e.g. pigmented inks, because the laser light is absorbed directly at the pigment surface of the printing substance, or an absorption layer must be provided which initially absorbs the laser light and then transfers the energy to the printing substance.

When using a light-permeable ink carrier in which the laser beam is focused from the inside through the ink carrier onto the absorption layer, it has however transpired in some cases that either the energy transferred onto the printing substance is not sufficient to detach an ink droplet from the printing substance, or there is the risk that the absorption layer is detached from the ink carrier by the transferred energy quantity.

The energy-releasing apparatus is therefore advantageously arranged such that the light beam is directed onto the absorption layer, not through the ink carrier, but from the side of the ink carrier carrying printing substance. In this case, the light beam is initially guided through the (non-absorbent) printing substance and then strikes the absorption layer. It has surprisingly transpired that, in the case of such an arrangement, the risk of detachment of the absorption layer from the ink carrier is clearly reduced.

Furthermore, it has also surprisingly transpired that the direction of movement of the energy-receiving printing ink droplet depends only very little on the angle at which the light beam strikes the surface of the printing substance. It is therefore not absolutely necessary, as is the case in the above-described version, that there is arranged opposite the ink carrier a light-permeable transfer means through which the light beam is guided in order that it strikes the surface of the printing substance roughly perpendicular.

Rather, as also in connection with the versions shown in the figures, the laser beam can form an angle greater than 0° and preferably smaller than 75°, particularly preferably smaller than 60° "diagonally", i.e. with the normal on the printing substance surface. In order to guarantee an optimal transfer of the printing point onto the imprinting material or the transfer means, the distance between the focus point of the light beam and the location of the printing point to be set on the imprinting material or transfer means is selected to be smaller than 2 mm, preferably smaller than 1 mm, particularly preferably smaller even than 0.5 mm.

With regard to the printing machine, the initially mentioned object is achieved by a printing machine for the printing of an imprinting material with an ink carrier or an energy-releasing apparatus which is arranged and developed such that energy can be transferred in a targeted manner onto specific areas of the ink carrier, the ink carrier being provided in order to receive printing substance essentially forming a homogeneous or continuous film. The ink carrier is advantageously developed as a cylindrical body which is preferably developed as a hollow cylinder with an essentially smooth surface.

Alternatively, it can however be advantageous for some cases of application if the ink carrier is a level plate. In principle, the development both as a cylinder and as a flat plate is possible, the refilling of the printing substance being easily possible in the case of the hollow cylinder, while the feeding of the imprinting material is easily realizable in the case of the flat plate.

The ink carrier is advantageously made of translucent material, preferably of glass. This makes it possible to use as energy-releasing apparatuses light-emitting devices which release the energy directly into the printing substance for example from the inside of the hollow cylinder through the translucent material.

In an expedient version, the ink carrier has a thickness of between 1 mm and 20 mm, preferably of between 2 mm and 10 mm and particularly preferably of roughly 5 mm.

In a preferred version, the ink carrier developed as a cylinder has a maximum deviation from the ideal cylinder shape of below 200 μm, preferably of below 100 μm, in particular of below 80 μm.

In particular if the imprinting material and the ink carrier or the printing plate are arranged distanced from each other during the printing procedure, a defined distance is preferably maintained very precisely. It is therefore provided in an expedient version that the cylindrical ink carrier has an external housing. Due to this external housing, the distance between the imprinting material and the ink carrier can be set exactly. A generally present ovality of the cylindrical ink carrier is absorbed by the external housing. The external housing can consist for example of at least one, preferably two, particularly preferably 3 rollers or cylinders on which the cylindrical ink carrier lies. The external storage area is preferably designed in such a precise way that the distance between the ink carrier and the imprinting material during the rotation of the ink carrier is less than 50 μm, preferably less than 20 μm and particularly preferably less than 10 μm. In addition, a manufacture of the cylindrical outer surface of the ink carrier (print drum) with as low tolerances as possible is naturally advantageous, above all for quiet running and the maintaining of a constant distance. However, the external housing could probably be dispensed with only if, for transparent hollow cylinders with an external diameter of the order of 300 mm, the tolerance deviations of the casing surface can be kept below the above-mentioned variation values, preferably below 10 μm.

Naturally it is possible to transfer the energy directly into the printing substance. However, this assumes that the printing substance is in a position to absorb light energy for example. In order to increase the variety of usable printing substances, it is therefore provided in a preferred version that there is arranged on the ink carrier an absorption layer which preferably has a thickness which is smaller than 10 μm, preferably smaller than 5 μm, particularly preferably smaller than 1 μm or even better smaller than 0.5 μm.

In particular in the cases of application in which a greater ink layer thickness on the imprinting material is desired, it has transpired that the surface of the section of the ink carrier receiving the printing substance is if at all possible designed not to be completely smooth (in the sense of optically shining), but somewhat matt or roughened. This can for example be achieved through the use of frosted glass. Particularly good results are achieved with surfaces which have an arithmetic central roughness of at least 0.1 μm, preferably between 0.5 μm and 5 μm, particularly preferably roughly between 0.1 μm and 2 μM. Such ink carrier surfaces are also still regarded as "essentially smooth" within the meaning of the present invention, in contrast to surfaces provided with macroscopic recesses (cells or grooves) or elevations in a targeted manner. In these versions with matted surfaces, several ink layers can also be "printed" one after the other. The fact that the surface of the ink carrier is not completely smooth means that the ink carrier is in a position to receive an increased quantity of printing substance. The result of the "printing" of a point is then that, at the same location, sufficient printing substance remains on the ink carrier in order to print further printing points.

For some cases of application, it can however be advantageous if a printing plate is additionally provided. This printing plate serves to give the individual printing points their form. In a preferred version, the printing plate has a plurality of cells and/or grooves which are provided to receive printing substance, and in particular can receive much more printing substance per surface unit than smooth or matted surfaces.

Alternatively, the printing plate can also be developed in the form of a grid, with the result that so-called meshes are provided instead of cells or grooves. The grid form has the advantage that the interconnection of the individual meshes automatically results without corresponding connection channels having to be provided. In other words, here also the printing substance forms an essentially continuous film along the ink carrier.

The development of the print carrier in such a way that the printing substance forms a continuous, coherent layer, with the energy transfer necessary to detach a printing droplet taking place so quickly that the droplet is detached in a well-defined form and size, enables the use of a large variety of printing substances.

The printing plate is for example secured on a cylindrical and transparent printing ink carrier such that the ink carrier is enclosed by the printing plate. It is possible both that the printing plate and the ink carrier are developed in one piece with each other and that the printing plate can be secured to the ink carrier in detachable manner. An alternative version to this provides that the printing plate is designed as a belt, preferably as a continuous belt. In this case, the ink carrier need not necessarily rotate, as long as the feeding of the printing substance is ensured by some other means.

The energy-releasing apparatus consists preferably of at least one laser source. Arrangements of laser diodes can also be used as laser sources under certain circumstances, however "classic" lasers, with an output of the order of 50–100 W or even more, are still currently preferred. Furthermore, an expedient version provides a focusing apparatus which focuses the laser beam onto a predefined point on the ink carrier. This focusing apparatus can be for example an f-theta lens system. However, all other suitably focusing apparatuses can naturally also be used.

In particular if the ink carrier consists of a transparent hollow cylinder with only a small diameter, in design terms it is possible only with great difficulty to arrange the energy-releasing apparatus inside the hollow cylinder. In this case, the provision of a reflecting apparatus, with the help of which the laser beams that are released by the energy-releasing apparatus are diverted onto the printing substance, can be very advantageous.

The reflecting apparatus can be for example a reflecting mirror, the vertical on the reflecting surface and the vertical on the imprinting material plane preferably forming an angle of roughly 45° at the time of the imprinting.

This arrangement has the advantage that the laser beam can be aligned essentially parallel to the rotation axis of the ink carrier and therefore the energy-releasing apparatus can be arranged next to the ink carrier.

In a preferred version, there is additionally provided an addressing apparatus, separate from the energy-releasing apparatus, which is triggered in order to reflect the laser beam onto the corresponding point on the print carrier. This addressing apparatus can have for example a polygonal mirror rotatable about its axis. This has the advantage that the energy-releasing apparatus need not be moved for the addressing of the individual printing points.

A facet angled onto a polygonal mirror with for example eight facets uniformly angled (at 45°) to each other in principle enables the deflection of a laser beam between a minimum and a maximum angle which cover a range of 90°. However, in order to use the f-theta lens system, the laser beam used must be considerably widened and the polygonal mirror naturally has a finite size, the laser energy being able to be fully exploited only if the widened beam fully strikes precisely the active facet of the polygonal mirror. The laser beam which in principle is available in permanent operation (although it can, if necessary, be a pulsed laser with ultra-short pulses and correspondingly short pulse intervals) cannot be used or at any rate cannot be used to its full capacity, as long as the widened beam strikes the corner area between two neighbouring facets. Given the widenings used in practice and a reasonably manageable size of the polygonal mirror, this ultimately means that only a deflection area of the laser beam at the polygonal mirror of roughly 45° can be used (in the case of a polygonal mirror with eight facets), with the result that within this 45° range a complete printed line must lie or be scanned. During the further rotation of the polygonal mirror, during which the laser beam sweeps over a corner area between two neighbouring facets, the laser beam cannot be used, i.e. a brief pause in printing takes place.

In a particular version of the present invention, it is therefore provided that the laser beam is split in a kind of "time multiplex process" or guided over two different paths, one beam part being directed such that it fully strikes precisely the relevant polygon facet from an accordingly chosen direction preferably staggered by 20° to 80°, while the other branch of the beam would strike a corner area at the transition between two facets. The changeover between the two beam branches, which preferably strike the polygonal mirror at an angle staggered by 45° relative to each other, can take place for example by means of a metallized shutter disk (interrupter disk) which alternately has passage openings and mirror surfaces and which is synchronized with the rotation of the polygonal mirror in a suitable manner, in order that the beam is either guided through or diverted by a mirror of the shutter disk, in order that it runs over a different path from the beam which passes through the corresponding gaps of the shutter disk and strikes the shutter mirror on a first path.

Alternatively, instead of the shutter disk, the use of a polarized laser beam in conjunction with an electro-optic modulator would also be possible. The electro-optic modulator rotates the polarization direction of the laser light which is then either reflected by 90° at a polarization filter or is guided completely through the filter if the polarization direction of the laser is correct. An alternating guiding or diverting of the beam along two different paths can also be achieved in this way, synchronized in turn with the rotation of the polygonal mirror by suitable electronic triggering of the electro-optic modulator, with the result that at any moment one of the two beams fully strikes a facet surface of the polygonal mirror, while the beam via the other path would otherwise strike the transition area between two polygon facets. In this way, the scanning ratio (duty cycle) of the laser beam, which is otherwise only roughly 0.5 due to the practical limitations, can be increased to the maximum value of 1.

It is self-evident that a laser array can also be used instead of an individual laser.

The absorption layer preferably consists of crystalline material, and the size of the individual crystals should be as small as possible. Nanocrystalline material, e.g. carbon or so-called "gas black" has advantageously been used as an absorption layer, the size of the individual crystals being roughly between 10 and 1000 nm. The size of the individual crystals is advantageously chosen to be smaller than the wavelength of the laser light used.

The absorption layer is preferably secured to the print carrier with polysilicate.

If the light-emitting device is arranged=inside the ink carrier developed as a transparent hollow cylinder, the light beam is focused through the transparent hollow cylinder onto the absorption layer. On the one hand, the absorption layer must be active enough to absorb the light and at the same time be in a position to pass on as much of this energy as possible as directly as possible to the printing substance. On the other hand, the absorption layer must be such that it is not detached from the ink carrier by the light beam.

It can therefore be advantageous for some versions if the light-emitting device is arranged such that the light beam is guided through the printing substance onto the absorption layer. This has the advantage that the pulse transfer from the laser beam onto the absorption layer presses the absorption layer onto the ink carrier and does not—as in the first case—detach the absorption layer from the ink carrier.

It has surprisingly transpired that the light beam does not necessarily have to strike the absorption layer or the ink carrier absolutely perpendicularly. The change in volume and/or position induced by the light beam in most cases runs essentially in the direction of the normal on the surface of the ink carrier.

Further advantages, features and possible applications of the present invention will become clear from the following description of preferred versions as well as from the enclosed figures.

Figure 1B:
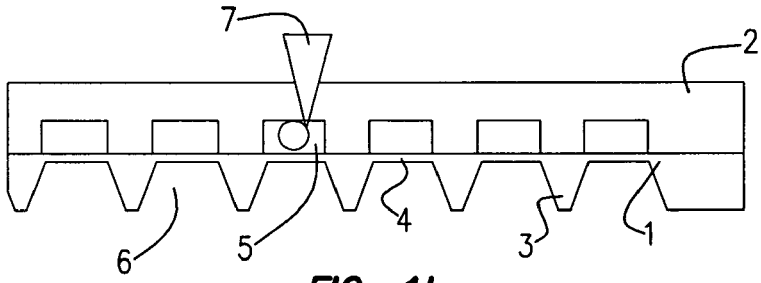
Figure 2A:
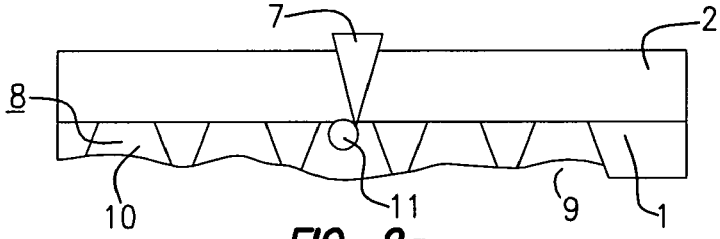
Figure 2B:
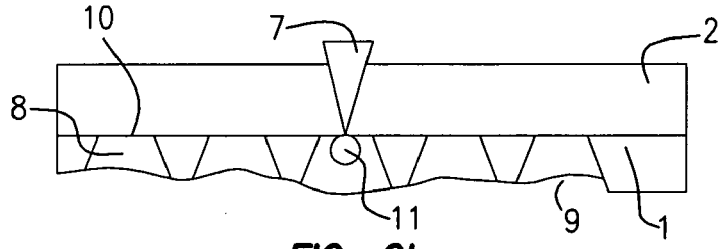
Figure 2C:
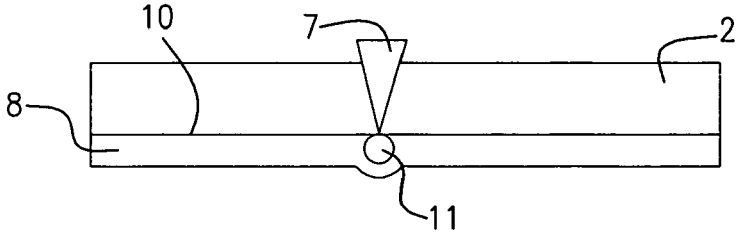
Figure 2D:
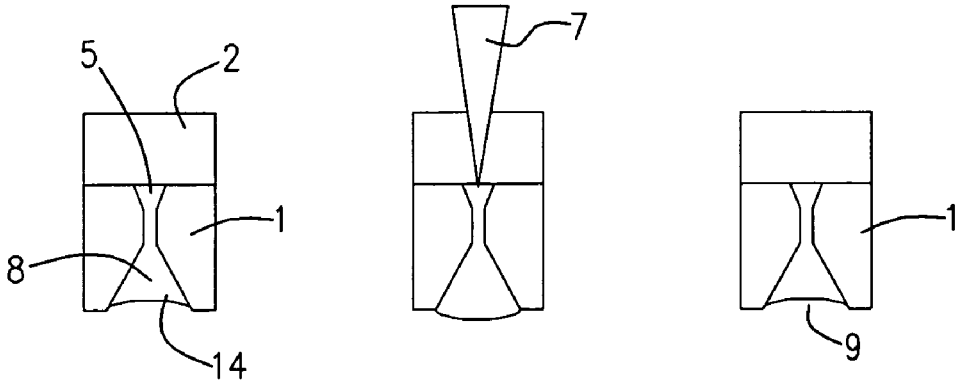

In FIGS. 1 *a*) and *b*) as well as FIGS. 2 *a*) to *d*), various versions of the ink carrier are represented with and without a printing plate. In FIGS. 1 *a*) and *b*), the ink carrier 2 is covered by a printing plate 1 which on the side facing the ink carrier has so-called antechambers 5 which are filled with an absorption material 10. The antechambers 5 are separated from the cells 6, which are filled with a printing substance 8, by an elastic membrane 4. The cells 6 are separated here by so-called projections 3 at the side facing the imprinting material which is not represented in further detail here. In addition, the individual cells are connected to each other by suitable connection channels (not shown here), in order that the printing substance can form an essentially homogeneous film which extends over several cells. The cut section shown in FIG. 1 *b*) differs from the cut section 1 *a*) in that the printing plate 1 has no antechambers 5 separated from the cells 6, but in this case the absorption material 10 in the printing plate 1 is anchored to the base of the cells 6, with the result that the energy beam 7 is first converted by an absorption material 10 into heat. The absorption material need not necessarily be arranged in separate chambers, but can for example also be developed as a continuous layer.

Located within the ink carrier 2 cylindrically shaped in the version shown, is an energy-releasing apparatus, here in the form of a laser arrangement, which is in a position to address each cell 6 through at least one beam. The laser light is controllable such that the printing substance 8 located on the surface of the printing plate 1 is selectively triggerable over the width of the ink carrier 2 in the area of the print gap, i.e. in the area in which the imprinting material is moved towards the ink carrier or the printing plate.

Further versions are shown in FIGS. 2 *a*) to *d*). In these versions, the printing substance 8 is applied to the ink carrier. The energy-inducing process, i.e. the printing procedure, is shown in FIG. 2 *a*). The cells 6 are filled with a printing substance 8, their absorption material 10 here having being introduced as a dispersion into the printing substance 8. It should be emphasized at this point that the absorption material 10 is not absolutely necessary if correspondingly suitable printing substances are used. The use of an absorption means, e.g. as a continuous layer or by mixing the absorption material into the printing substance, is necessary only if the printing substance is not in a position to absorb the light energy introduced.

In FIG. 2 *a*), the energy beam 7 is focused into the cell 6. The absorption bodies 10 located in the printing substance 8 absorb the energy of the energy beam 7 and convert it into heat, with the result that the solvent located in the printing substance 8 evaporates. Through this sudden evaporation of the solvent, the printing substance 8 is thrown from the cell 6.

In the versions shown in FIGS. 1 *a*) and *b*) with a membrane, the energy transfer need not necessarily take place through a transfer of heat. Rather, it is also possible that the absorption means heated by the laser beam expands and the printing substance transfers via the membrane 5 *a* pulse which ensures that the printing substance 8 rises over the external contour of the ink carrier or the printing plate.

In FIG. 2 *b*), essentially the same procedure is represented as in FIG. 2 *a*). However, here the absorption material 10 is not introduced into the printing substance 8, but is arranged as a solid layer on the base of the cell in the printing plate 1. It is clear from this that the absorption means need not necessarily be separated from the printing substance 8 by a membrane 5. Here the energy beam 7 is transformed by the layer-shaped absorption material 10 into heat, which in turn brings the solvent in the printing substance 8 to the boil. Through this sudden evaporation of the solvent, the printing substance 8 is thrown from the cell 6.

A version without a separate printing plate is shown in FIG. 2 *c*). Here, only the printing substance 8 is located as a homogeneous film on the printing ink carrier 2. Also here, a laser pulse 7 causes the printing substance 8 to move beyond the external contour of the ink carrier. In other words, the printing of points can also be carried out entirely without a printing plate 1, which leads to a kind of portioning of the printing substance 8. The triggering of the printing point quantity as well as its expansion then takes place by the controlling of the pulse energy and the pulse length.

A version with specially formed cells 6 is shown in FIG. 2 *d*). It can be clearly recognized that the cells essentially consist of a channel which widens on both sides. The fact that, as shown in the middle representation of FIG. 2 *d*), the laser beam is focused into the widened area of the channel which faces the ink carrier 2, means that the relatively weak gas bubble formation in the printing substance 8 is increased and is aligned in the direction of the imprinting material due to the nozzle-shaped form. Through this nozzle-shaped form of the channel or the cells, the energy needed for printing can be reduced.

Figure 3A:
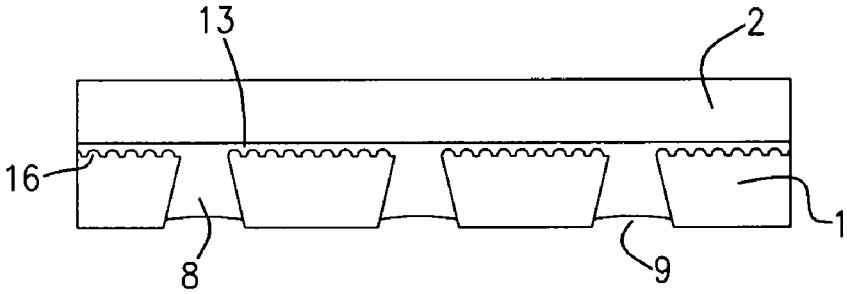
Figure 3B:
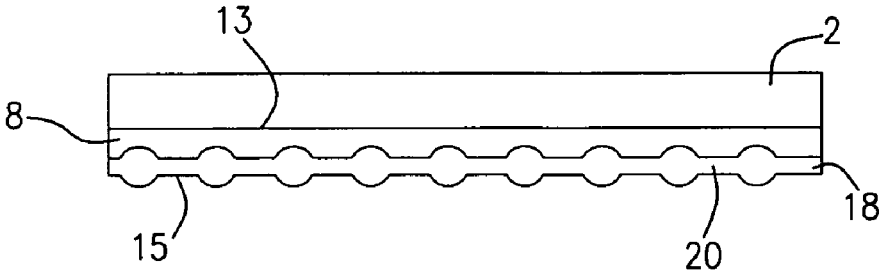

In FIG. 3 *a*) a version with a printing plate is shown, in which the connection of the individual cells can be recognized. The printing plate 1 has a roughened side 16 on the side facing the ink carrier 2, with the result that there forms between the ink carrier 2 and the printing plate 1 *a* gap 13 which guarantees a homogeneous distribution of the printing ink 8 of the cells 9 through occurring capillary forces between the printing plate 1, the ink carrier 2 and the printing substance 8. Furthermore, air inclusions are prevented and a homogeneous and defined filling of the cells with the printing substance becomes possible.

In the version shown in FIG. 3 *b*), a printing plate 1 is also arranged on the ink carrier 2. However, here the printing plate 1 is developed as a grid 18 and therefore has so-called meshes 15 instead of cells. Also here, the grid allows a homogeneous distribution of the printing substance 8 through the forming gap 13.

Figure 4A:
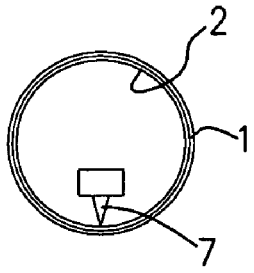
Figure 4B:
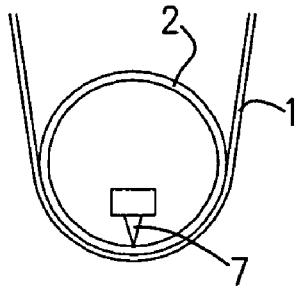
Figure 4C:
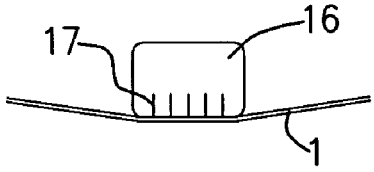

In FIG. 4 *a*), the cylindrical ink carrier 2 is shown in its entirety, the printing plate 1 seamlessly surrounding the cylindrical printing cylinder or the ink carrier 2. The laser arrangement 7 is located inside the printing cylinder 2.

Alternatively, the printing plate 1 can also run as a belt around the cylindrical printing cylinder or the ink carrier 2, as shown in FIG. 4 *b*). Here too, the laser arrangement 7 is located inside the printing cylinder 2.

As shown in the version in FIG. 4 *c*), the ink carrier 2 need not necessarily be developed as a rotating cylinder. In contrast, here the printing plate 1 runs as a belt past a firmly anchored print head 16. Arranged inside the print head 16 is a laser arrangement 17 which due to the limited space can be developed using semiconductor technology.

Figure 5A:
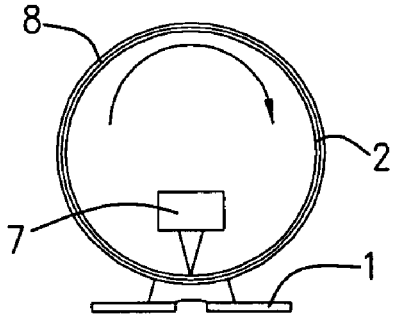
Figure 5B:
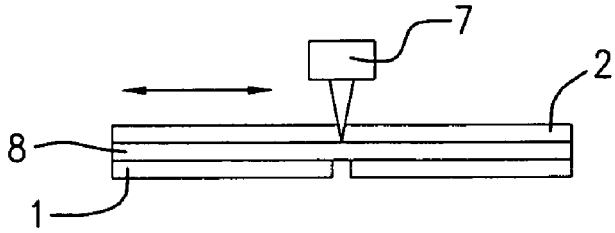

The ink carrier 2 is cylindrically shaped in the version of FIG. 5 *a*). No printing plate 1 is connected to the ink carrier 2, but the printing substance 8 is applied to the ink carrier 2 as a homogeneous film. However, here a printing plate 1 is provided which is arranged separately from the ink carrier 2 and here has the form of a diaphragm. By rotating the ink carrier 2, the feeding of the printing substance is secured with the help of a standardized ink system. In the case of this version, it must be borne in mind that the distance of the diaphragm-like printing plate 1 from the ink carrier 2 roughly corresponds to the layer thickness of the printing-substance film. This measure guarantees that too much printing substance 8 is never fed to the actual printing procedure and thus a welling out of the printing substance 8 is avoided.

In FIG. 5 *b*), the ink carrier 2 is developed as a flat disk with the result that the printing substance 8 is located as a homogeneous film on the underside of the flat ink carrier 2. Here, the printing plate 1 is also separated from the ink carrier 2 and also has the shape of a diaphragm. The feeding of the printing substance is secured here by a periodic back-and-forth movement of the flat print carrier 2.

Figure 6:
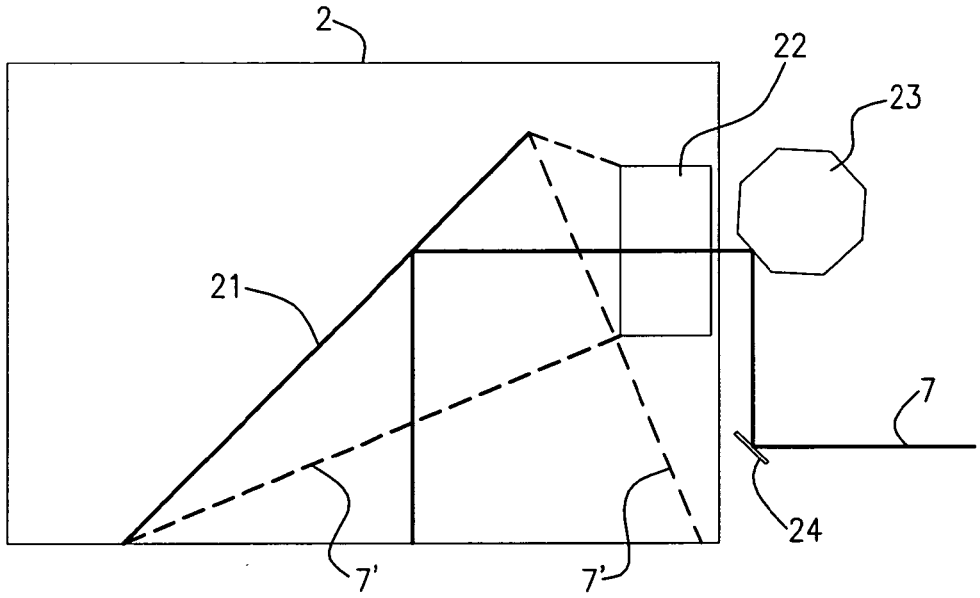
FIG. 6 shows a schematic representation of a reflecting lens system, FIG. 7 schematically a beam being guided along two paths in order to increase the duty cycle

Finally, FIG. 6 shows a reflecting lens system which is advantageously used together with the printing machine according to the invention. However, it is self-evident that this reflecting lens system is not limited to the described printing method according to the invention, but can be applied to all printing processes in which a laser beam is intended to be directed in a targeted manner onto a specific point of an ink carrier.

Represented in FIG. 6 is the ink carrier 2 which is developed as a cylinder. Located inside the cylinder is a reflecting mirror 21 which here forms an angle of 45° with the middle axis of the cylinder 2. Here the laser beam 7 is initially directed, at a first reflecting mirror 24 which need not necessarily be present, onto the addressing unit 23 which is designed here as a polygonal mirror. The addressing unit 23 is triggerable in order that the reflection of the laser beam 7 can be defined with the help of the polygonal mirror 23. After the laser beam 7 has been reflected by the addressing apparatus 23, it passes a focusing apparatus which is developed here as an f-theta arrangement and which has the reference number 22. Thereafter it strikes the reflecting mirror 21 and is focused onto the surface of the ink carrier 2. By way of example, two alternative beam paths 7' are represented which could result if the addressing apparatus 23 were set accordingly. Thus by triggering the polygonal mirror 23 without the actual laser having to be moved, every point of a line which runs on the surface of the ink carrier 2 parallel to the rotation axis of the ink carrier 2 can be triggered. More correctly, the focus point of the laser runs through each point of this line during the rotation of the polygonal mirror, the focus point being able to be switched on or off at any point (or pixel according to the possible resolution).

Figure 7:
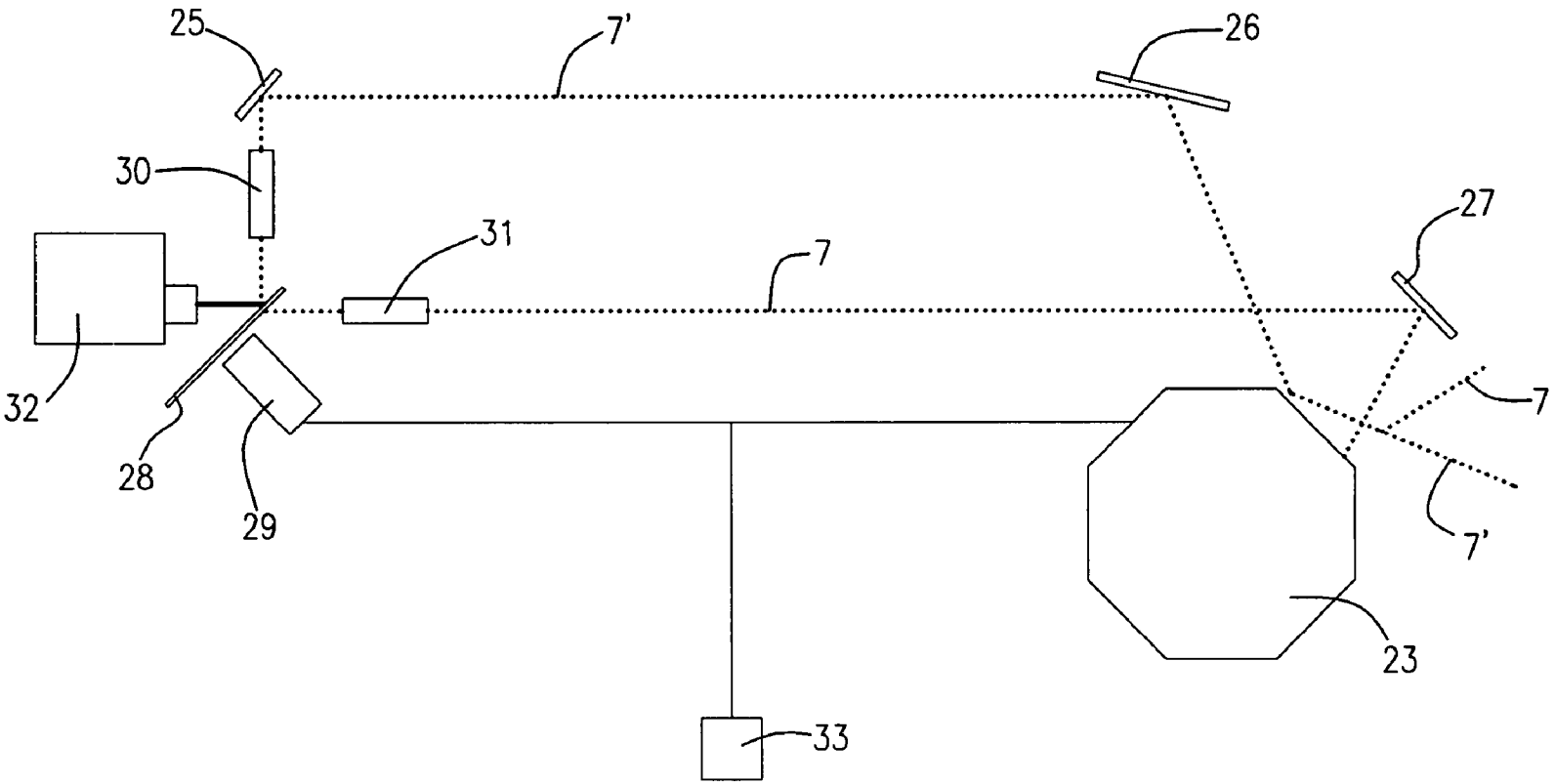

In FIG. 7, a laser source 32 can be recognized which produces a laser beam which is split into two different laser beams 7 and 7'. However, this split is not carried out by a conventional beam splitter which would produce half-capacity continuous beams 7 or 7', but by a metallized interrupter disk (shutter) which alternately has gaps in order to let through a laser beam 7 and metallized surfaces in order to deflect the laser beam 7'. The gaps and metallized surfaces preferably each have angle sectors of equal length and alternate with each other. In the preferred version in which a polygonal mirror 23 with eight facets is also used, the interrupter disk 28 also has eight passage openings and eight metallized surfaces which are distributed evenly around the perimeter of the interrupter disk 28. The drive 29 for the interrupter disk 28 is suitably synchronized via a synchronizing device 33 with the rotation of the polygonal mirror 23, the precise type of synchronization being described below.

Analogously to data transfer, reference could also be made to a time multiplex split of the laser beam into the beams 7, 7', but this has nothing to do with the very frequent switching on and off of the laser beam in order to address the individual printing points of a scanning line which is superimposed on the comparatively infrequent beam interruption and deflection.

After the splitting of the beam, a widening of the beam takes place in the units 30 or 31, which is not required until later in the f-theta lens system 22 no longer shown in FIG. 7, but represented in FIG. 6.

One part-beam 7 runs through a gap of the interrupter disk 28 and the beam extension 31, strikes a mirror 27 and from there is reflected at a fixed angle (according to the position of the mirror 27) onto the polygonal mirror 23 which rotates about its central axis running perpendicular to the paper axis. The beam 7' is initially deflected upwards by the metallized segments of the interrupter disk 28, runs through the beam extension 30, then strikes a mirror 25 and from there a mirror 26 which in turn directs the beam onto the polygonal mirror 23. It should be borne in mind that the mirrors here are only schematically reproduced and the mirror 26 is in every case aligned such that the beam falls onto the polygonal mirror. However, the impact points of the beams 7 or 7' on the polygonal mirror are chosen such that, measured in the circumferential direction of the polygonal mirror, they are staggered relative to each other roughly by half the length of a facet surface.

It may be assumed that the polygonal mirror 23 rotates anticlockwise, the laser beams 7, 7' always being reproduced broken down into individual bundles, which corresponds to the alternating interruption of the two beams, although in reality the individual "bundles" are much longer and would have to be represented with correspondingly larger gaps. The interrupted beam representation in FIG. 7 therefore corresponds more to the individual printing point pulses which are directed onto the print carrier in a scanning line.

In FIG. 7 a situation is represented where the laser beam 7 penetrates a gap in the interrupter disk 28 and strikes one of the facet surfaces above the mirror 27. The length of the gap or interruption in the interrupter disk 28 is to be of such a size that the relevant facet of the polygonal mirror passes almost completely through the area on which the beam 7 strikes. This means that the beam 7 first strikes the relevant facet of the polygonal mirror when the preceding corner between neighbouring facets has just passed this area. While the polygonal mirror continues to rotate, the relative alignment of the polygonal mirror facet to the laser beam 7 changes, as a result of which the laser beam 7 reflected by the polygonal mirror covers an angle range which approximately extends from a horizontal up to a 45° angle, this 45° angle being almost reached in the snapshot representation according to FIG. 7.

Shortly before the laser beam 7 strikes the next corner at the transition to the following facet, the beam 7 is interrupted by the interrupter disk 28, with the result that the beam 7' is now directed onto the relevant facet, and initially strikes that same facet immediately behind the corner to the preceding facet as was previously scanned by the beam 7. The same procedure occurs here as in the case of the beam 7, i.e. the beam 7' is, starting from a deflection of approximately 45° downwards vis-à-vis a horizontal, swivelled roughly into a horizontal, while the polygonal mirror continues to rotate anticlockwise. The next corner to the transition of the next facet has then passed the impact point of the beam 7 and at the same time the interrupter disk 28 in turn releases the beam 7, with the result that the beam 7' vanishes and the beam 7 now strikes the next facet. As already mentioned, the representation in FIG. 7 is merely schematic and the positions and angles that have been drawn in need not agree exactly with the positions and angles realized in the case of a realistic design.

The essential reason for this configuration lies in the fact that the beams 7, 7' are relatively markedly widened in relation to the effective length of the individual facets and are not usable as long as they do not strike one of the facets with their full beam cross-section. The use time (duty cycle) of the laser is therefore only roughly 50% or 0.5. However, by dividing the laser beam into the two part-beams 7, 7' a duty cycle of 1 (scanning ratio 1) can be achieved, i.e. while one beam must be inactive, because it is passing the area of a corner at the transition between two facets, the other beam, the impact point of which is staggered by at least the amount of the diameter of the beam or of the width of the beam, and for example roughly by half a facet length, can be active with the result that the laser energy that is essentially continuously available is also continuously used. It is self-evident that the interruption of the beam with the help of the interrupter disk is independent of the other addressing interruption with which the individual points of a printed image are triggered.

Instead of the interrupter disk, it is also possible to use a polarization filter if the laser operates with polarized light, in which case there is also connected, before a suitable polarization filter, an electro-optical modulator which is in a position to rotate the polarization plane by 90°. Depending on whether the electro-optical modulator is active, the polarization filter then allows the laser radiation to pass unhindered or reflects it through a suitable arrangement by 90°, with the result that exactly the same division into the beams 7, 7' can be achieved as was described with reference to the interrupter disk.

Figure 8:
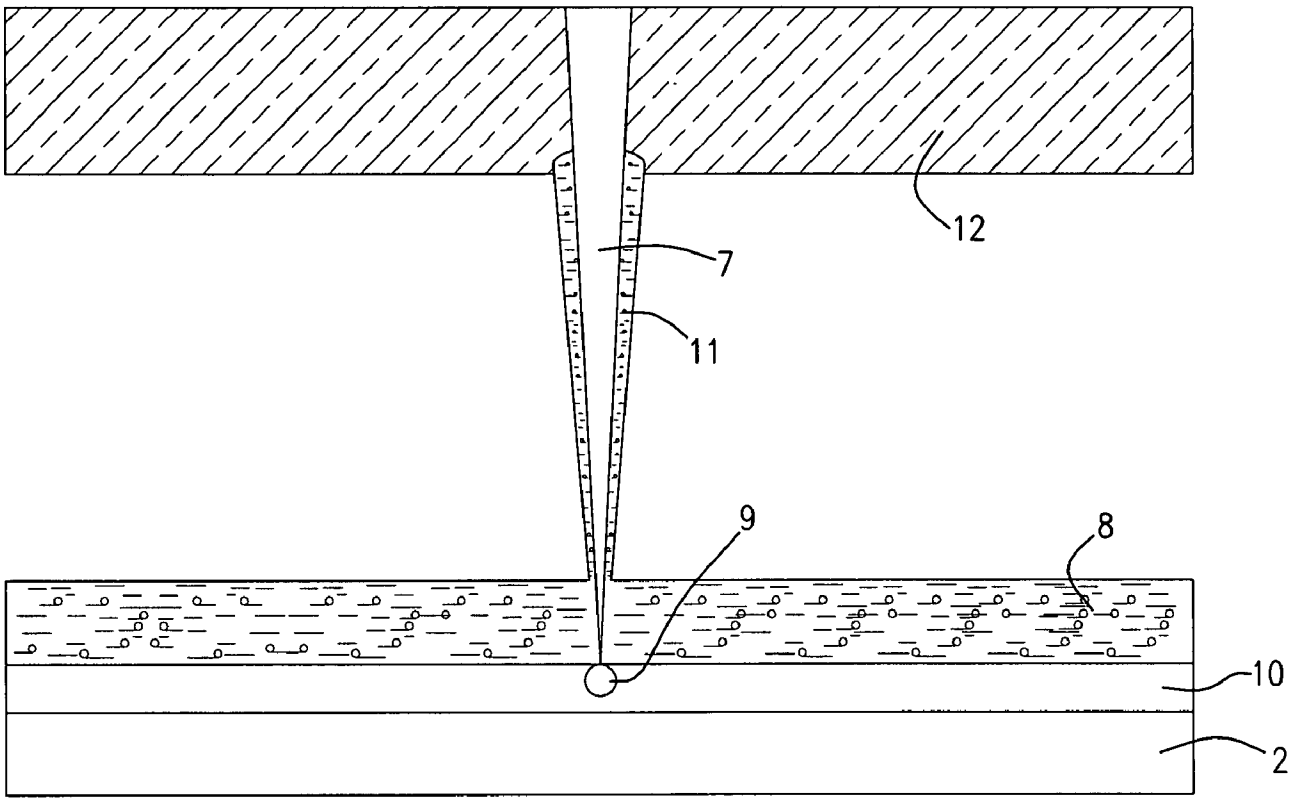
FIG. 8 shows a basic representation of a further alternative printing arrangement.

In the versions described thus far, the energy or the laser beam was focused through the (transparent) ink carrier into the absorption layer or into the printing substance. In FIG. 8, on the other hand, it is shown that this is not absolutely necessary. Rather, the laser beam can for example also be focused from the other side, i.e. from the side of the ink carrier carrying printing substance, into the printing substance or the absorption layer.

In FIG. 8, the laser beam 7 is focused through a transparent glass cylinder, which here serves merely as a transmission means, through the printing ink 8 onto the absorption layer 10 applied to the ink carrier 2, at point 9. The absorption layer 10 absorbs at least part of the energy from the laser beam 7 and passes this on into the printing substance 8. As a result, there is a sudden local heating of the printing ink and a printing ink droplet 11 is explosively detached from the printing ink layer 8. This printing ink droplet 11 reaches the glass cylinder 12. In this way a glass cylinder could be imprinted. In general, however, non-transparent imprinting materials 34 are not to be printed on, so that the printing point placed on the glass cylinder 12 has to be transferred onto the imprinting material 34.

Figure 9:
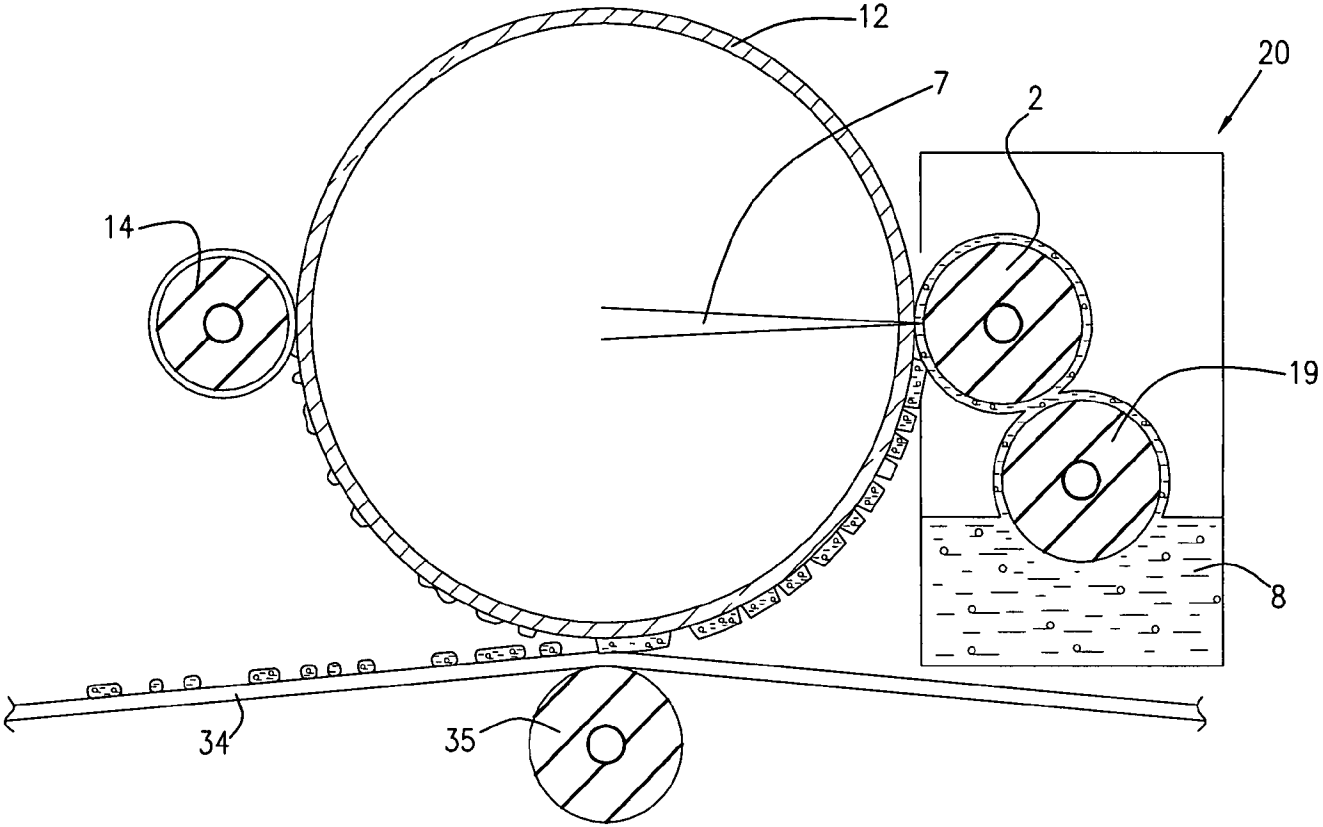
FIG. 9 shows a schematic representation of a printing arrangement which is based on the principle represented in FIG. 8.

In FIG. 9, the structure of a printing machine which uses the arrangement that has just been described is schematically represented. A laser beam 7 is focused through the glass cylinder 12 (transfer means) onto the ink carrier 2, optionally provided with an absorption layer 10 and here developed in the form of a roller. If the ink carrier 2 is equipped with a printing plate 1, then the glass cylinder 12 and the ink carrier 2 can touch each other. However, if the ink carrier has no specially developed printing plate 1, but is merely wetted by the printing substance 8, then, as described above, the glass cylinder 12 and the ink carrier 2 should be kept at a distance from each other.

The ink carrier 2 is integrated into an inking unit 20 which, together with the ink carrier 2, also includes a dipping roller 19 and a printing substance bath 8. The external contour of the dipping roller 19 is immersed in the printing substance bath 8. If the dipping roller 19 is rotated, it is thereby ensured that the surface of the dipping roller 19 is carrying printing substance. The dipping roller is brought towards the ink carrier 2 at least to the point where a transfer of the printing substance 8 from the dipping roller 19 onto the print carrier 2 takes place.

It is thus ensured through the inking unit 20 that at any time there is printing substance 8 on the surface of the ink carrier 2. If the laser beam now strikes the surface of the ink carrier 2, a local change in the volume and or position of the printing substance 8 is induced, either directly or via an absorption layer 8, as a result of which a droplet with printing substance 8 is transferred from the ink carrier 2 onto a transfer means, e.g. the glass cylinder 12. The glass cylinder is rotated clockwise in the arrangement shown in FIG. 9, with the result that the surface section of the glass cylinder 12 has been transferred onto that of the printing substance droplets whenever contact occurs with the printing material web 34 running between supporting cylinder 35 and glass cylinder 12. Similarly to offset printing, the printing ink is therefore initially positioned on the glass cylinder 12, and positioned on the actual imprinting material 34 only in a subsequent step.

Since, as a general rule, the printing substance 8 is not completely transferred from the glass cylinder onto the imprinting material 34, a cleaning roller 14 is advantageously used with which the glass cylinder 12 is cleaned.

Figure 10:
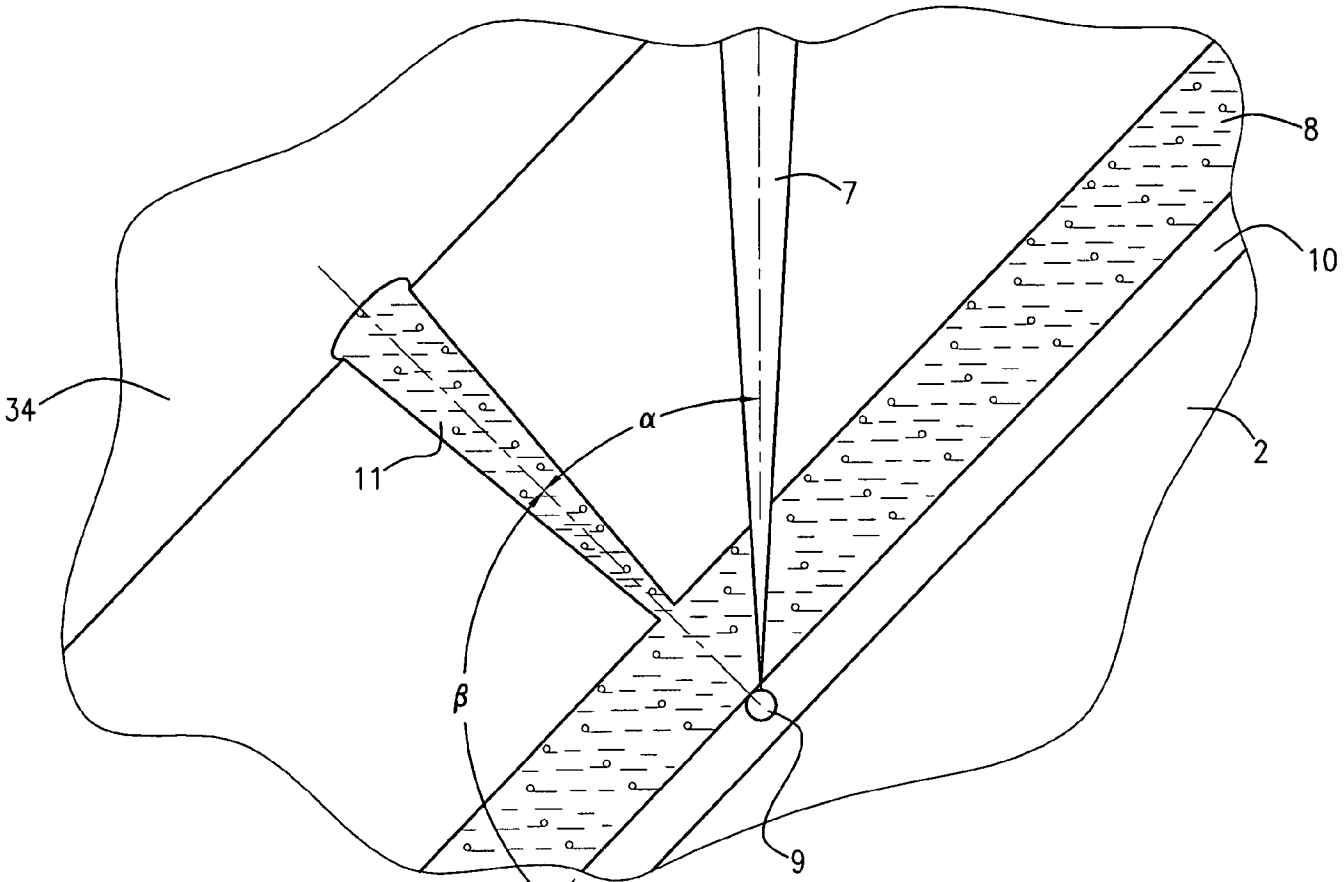
FIG. 10 shows a basic representation of a further alternative printing arrangement and FIGS. 11*a*) and 11*b*) show schematic representations of a printing arrangement which is based on the principle represented in FIG. 10.

As already stated, it is not absolutely necessary for the laser beam 7 to strike the ink carrier 2 perpendicularly. A different arrangement is therefore shown in FIG. 10. Here, the laser beam 7 forms an angle a with the normal on the ink carrier surface. It transpired surprisingly that the angle $\beta$ between the ink carrier surface and the direction of the printing ink point detached from the printing substance is virtually independent of the angle $\alpha$. In FIG. 10, therefore, the imprinting material 34 is brought towards the ink carrier 2, the laser beam being concentrated laterally between the imprinting material 34 and the ink carrier 2 onto the focus point 9 in the absorption layer 10 or the printing substance 8 in order to print a printing point. As a result of the generation of heat in the printing substance 8, a droplet 11 of the printing substance 8 undergoes a change in volume and/or position, with the result that it leaves the printing substance film 8 almost perpendicular to the ink carrier surface.

Figure 11A:
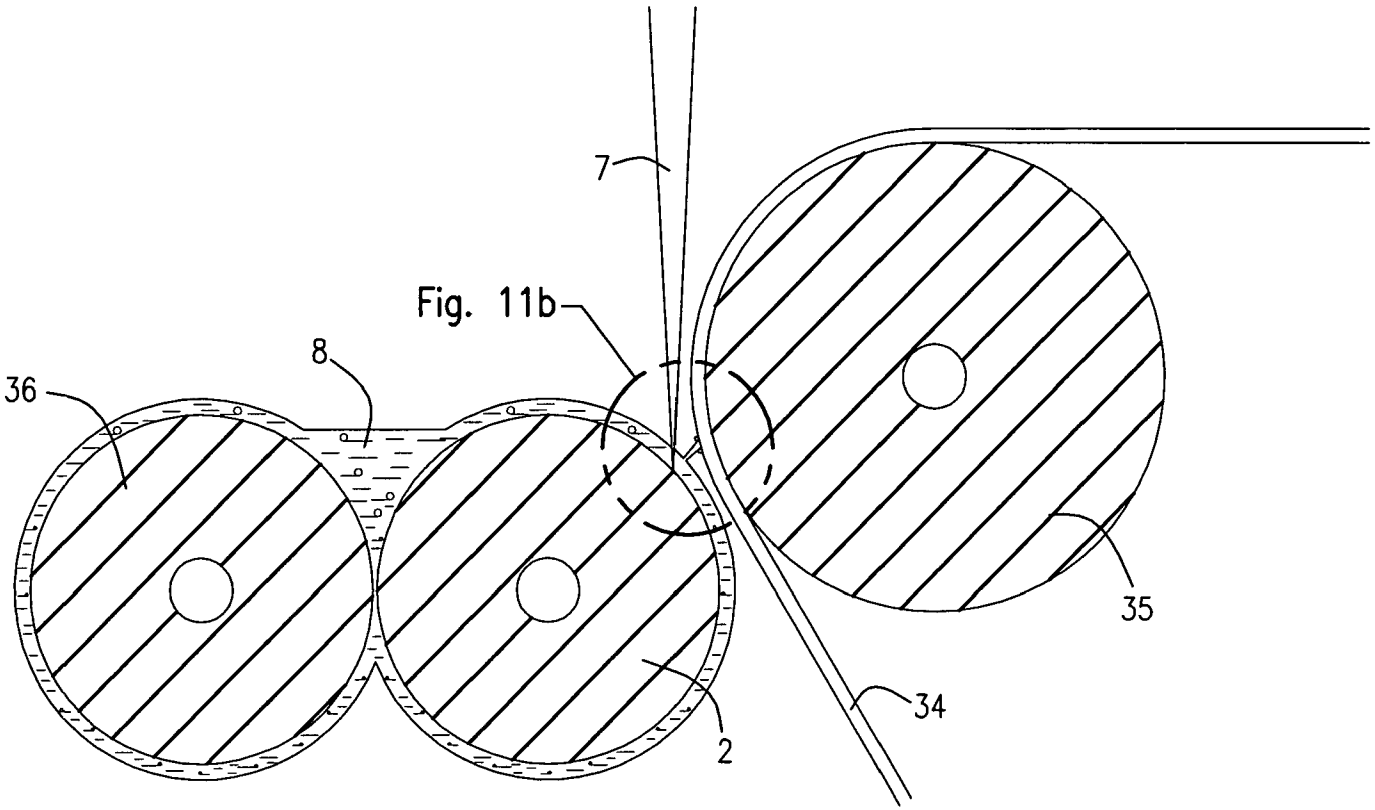
Figure 11B:
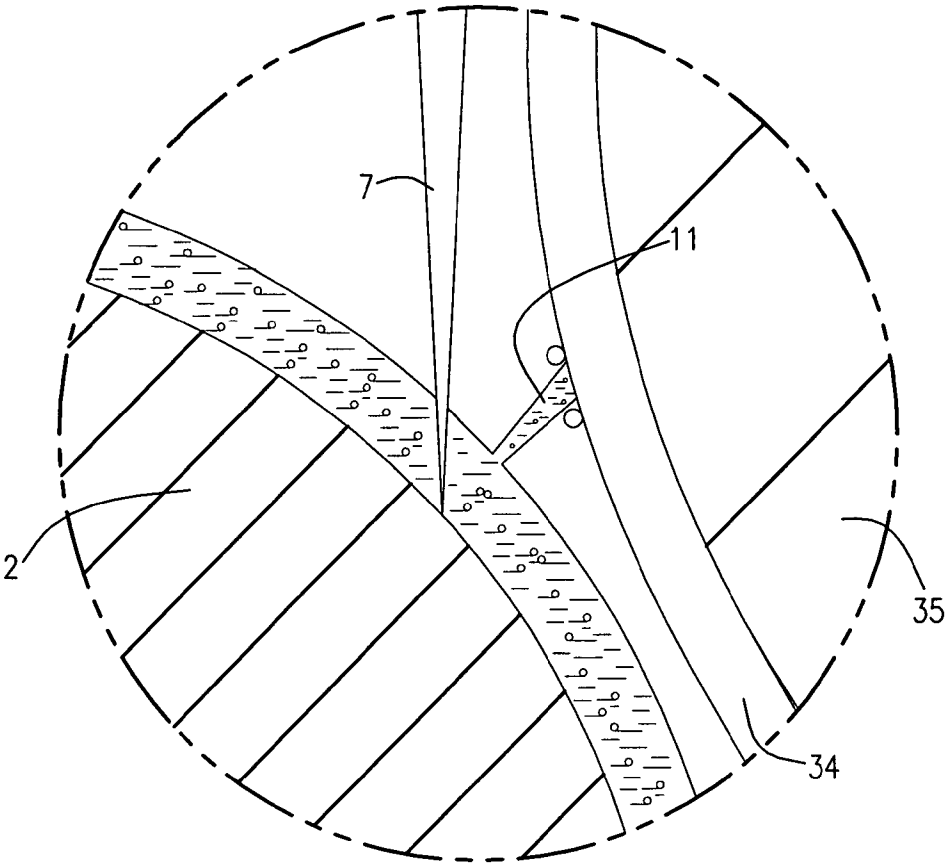

There is shown by way of example in FIGS. 11*a*) and 11*b*) a printing machine which realizes the laser arrangement that has just been described. An ink carrier roller 2 is integrated into an inking unit which, in addition to the ink carrier roller 2, also comprises the transfer roller 36 as well as the stock bath with printing ink 8. With the help of the inking unit, it is ensured that the ink carrier roller 2 is always wetted with printing substance 8 at its surface. The laser beam 7 is directed directly onto the printing substance or the absorption layer on the ink carrier roller 2. In contrast to the previously described arrangements, here the laser beam 7 is not guided initially through a transparent body, so that it strikes the printing substance or the absorption layer lying beneath it perpendicular to the surface of the former.

As is represented enlarged in FIG. 11*a*), the laser beam 7 strikes the absorption layer of the ink carrier roller 2 which is continuously inked with a printing ink that is transparent for the laser beam. The focus of the laser beam 7 is projected at a specific angle onto the surface of the inking roller. This angle is advantageously chosen such that the distance between the focus point and the imprinting material is optimum. The laser beam is then guided in the manner described line by line over the inking roller and the items of information or the printing points are transferred by switching the laser on and off. When the laser is switched on, the laser light is absorbed in the absorption layer, the solvent in the printing ink is evaporated, and a local change in the volume and/or position of the printing substance is induced, with the result that the printing ink droplet that forms sets the desired printing point. The web support roller guides the imprinting material in such a way that the distance between the imprinting material and the focus point becomes as small as possible, but the imprinting material neither interrupts the laser beam nor touches the inking roller.

The ink carrier roller 2 advantageously has a smaller diameter than the web support roller 35.

Through the process according to the invention and the printing machines according to the invention, a digital printing process is provided which allows virtually all conceivable printing substances or imprinting materials to be printed or imprinted. Thus for example conductive coatings or caustic substances can also be applied to printed wiring boards. A further possible application is rapid prototyping. The inking rollers can—at least if the energy is not transferred through the inking roller—be made from virtually all materials, preferably from metal or ceramics. Moreover, they can be porous or have rough surfaces.

List of reference numbers:

| | |
|---|---|
| 1 | Printing plate |
| 2 | Ink carrier |
| 3 | Projections |
| 4 | Elastic membrane |
| 5 | Antechambers |
| 6 | Cells |
| 7, 7' | Laser beam |
| 8 | Printing substance |
| 9 | Focus point |
| 10 | Absorption material |
| 11 | Printing substance droplet |
| 12 | Glass cylinder |
| 13 | Gap |
| 14 | Cleaning roller |
| 15 | Meshes |
| 16 | Roughened side |
| 17 | Laser array |
| 18 | Grid |
| 19 | Dipping roller |
| 20 | Inking unit |
| 21 | Reflecting mirror |
| 22 | f-theta array (lens system) |
| 23 | Addressing apparatus |
| 24 | Reflecting mirror |
| 25 | Mirror |
| 26 | Mirror |
| 27 | Mirror |
| 28 | Interrupter disk (shutter) |
| 29 | Interrupter disk drive |
| 30 | Beam-widening device |

-continued

| List of reference numbers: |
|---|
| 31 Beam-widening device |
| 32 Laser source |
| 33 Synchronization device |
| 34 Imprinting material or imprinting material web |
| 35 Supporting cylinder |
| 36 Transfer roller |

The invention claimed is:

1. A printing process for the transfer of a liquid printing substance (8) from an ink carrier (2) onto an imprinting material or transfer means comprising applying the liquid printing substance in the form of an essentially continuous film on an ink carrier and causing the liquid printing substance on the ink carrier to undergo a change by means of localized energy transfer to the printing substance thereby causing a transfer of printing substance in the form of a printing point onto the imprinting material or transfer means wherein energy in the form of light from an energy releasing apparatus is initially transferred through the printing substance onto an exchange material and then from the exchange material to the printing substance to induce a localized change in the printing substance to cause the transfer of printing substance in the form of the printing point.

2. The printing process of claim 1 wherein surface roughness of the ink carrier is from about 0.1 to about 5 microns.

3. The printing process of claim 1 wherein the transfer means comprises glass.

4. The printing process of claim 1 wherein energy from the energy-releasing apparatus is transferred initially into said exchange material in the form of a homogeneous layer on the ink carrier and the energy is then transferred from the exchange material onto the printing substance.

5. A process according to claim 4 wherein the energy releasing apparatus releases energy in the form of light through the printing substance onto the exchange material thereby inducing a change in a physical property of the printing substance selected from the group consisting of volume of the printing substance, position of the printing substance and combinations thereof.

6. The printing process of claim 1 wherein the change is a change in a physical property of energized printing substance at a point of energization which property is selected from the group consisting of volume of the printing substance, position of the printing substance and combinations thereof.

7. The printing process of claim 1 wherein release of energy takes place by emission of a laser pulse and the thickness and diameter of the printing point can be varied by variation in laser energy and laser pulse length.

8. The process of claim 7 wherein a laser pulse with a pulse duration of less than 200 nanoseconds to about 1 microsecond is used for the energy transfer.

9. The process of claim 1 wherein a distance of about 10 microns to about 50 microns is maintained between the ink carrier and the imprinting material at a location of printing substance transfer to the imprinting material.

10. The process of claim 1 wherein a laser pulse with a pulse duration of less than 200 nanoseconds to about 1 microsecond is used for the energy transfer.

11. The process of claim 1 wherein the energy transfer is provided by a split laser beam guided at alternate time intervals over two different paths onto a rotating faceted polygonal mirror such that the paths are staggered by a distance of from at least the width of the beam to about one half of a facet length of the polygonal mirror and so that the beam on at least one of the paths always fully strikes a facet of the polygonal mirror and such that angle ranges of the paths join one another.

12. The process of claim 11 wherein the imprinting material is a transfer means that is permeable to light and the energy releasing apparatus releases energy in the form of light through the transfer means onto a side of the ink carrier that carries the printing substance thereby inducing a change in a physical property of energized printing substance at a point of energization which property is selected from the group consisting of volume of the printing substance, position of the printing substance and combinations thereof.

13. The process of claim 1 wherein the imprinting material is a transfer means that is permeable to light and the energy releasing apparatus releases energy in the form of light through the transfer means onto a side of the ink carrier that carries the printing substance thereby inducing a change in a physical property of energized printing substance at a point of energization which property is selected from the group consisting of volume of the printing substance, position of the printing substance and combinations thereof.

14. A printing machine for the imprinting of an imprinting material said machine comprising an ink carrier (2) and an energy-releasing apparatus arranged such that energy can be transferred in a targeted manner onto specific areas of the ink carrier (2), wherein the ink carrier (2) has a surface to receive printing substance (8) in the form of an essentially continuous film wherein the energy-releasing apparatus is arranged such that it can emit a light beam through the printing substance to the ink carrier to cause heat transferred from the ink carrier back to the printing substance, at an angle $\alpha$, to the normal on a printing substance surface, of more than 0° and preferably less than 75°.

15. A printing machine according to claim 14 wherein the surface of a section of the ink carrier (2) receiving the printing substance (8) has an arithmetic mean central roughness of between 0.5 μm and 5 μm.

16. A printing machine according to claim 14 wherein the surface of a section of the ink carrier (2) receiving the printing substance (8) has an arithmetic mean central roughness of between 1 μm and 2 μm.

17. A printing machine according to claim 14 wherein an absorption layer (10) is arranged on the ink carrier (2), said absorption layer (10) having a thickness less than 10 μm.

18. A printing machine according to claim 17 wherein the absorption material comprises nanocrystalline carbon ("gas black") secured on the ink carrier.

19. A printing machine according to claim 14 wherein a printing plate (1) is provided.

20. A printing machine according to claim 19 wherein the printing plate (1) is in the form of a grid.

21. A printing machine according to claim 19 wherein the printing plate is provided with several connected recesses that serve to receive printing substance (8).

22. A printing machine according to claim 19 wherein the printing plate (1) is secured in detachable manner to the ink carrier (2).

23. A printing machine according to claim 19 wherein the printing plate (1) is designed as a belt, preferably as a continuous belt.

24. A printing machine according to claim 19 wherein the printing plate (1) has the form of a diaphragm that is arranged separate from the ink carrier (2) and between the latter and the imprinting material.

25. A printing machine according to claim 14 wherein no printing plate (1) is provided.

26. A printing machine according to claim 14 comprising said energy-releasing apparatus including a laser and a focusing apparatus including an f-theta lens system (22) that focuses the laser (7) onto predefined points on the ink carrier (2).

27. A printing machine according to claim 14 wherein a reflecting apparatus is provided in the form of a reflecting mirror (21) having a reflecting surface, a vertical on the reflecting surface and a vertical on an imprinting material plane forming an angle of about 45° at the time of imprinting.

28. A printing machine according to claim 14 wherein an addressing apparatus having a faceted polygonal mirror rotatable about its axis is provided.

29. A printing machine according to claim 14 wherein a transfer means (12) is provided that comprises light-permeable material.

30. A printing machine for the imprinting of an imprinting material said machine comprising an ink carrier (2) and an energy-releasing apparatus arranged such that energy can be transferred in a targeted manner onto specific areas of the ink carrier (2), wherein the ink carrier (2) has a surface to receive printing substance (8) in the form of an essentially continuous film wherein the energy-releasing apparatus is arranged such that it can emit a light beam at an angle $\alpha$, to the normal on a printing substance surface, of more than 0° and preferably less than 75° wherein the surface of the ink carrier has an extensive tolerance deviation from an ideal planar or cylindrical surface of less than 20 μm.

31. A printing machine for the imprinting of an imprinting material said machine comprising an ink carrier (2) and an energy-releasing apparatus arranged such that energy can be transferred in a targeted manner onto specific areas of the ink carrier (2), wherein the ink carrier (2) has a surface to receive printing substance (8) in the form of an essentially continuous film wherein the energy-releasing apparatus is arranged such that it can emit a light beam at an angle $\alpha$, to the normal on a printing substance surface, of more than 0° and preferably less than 75° wherein said energy-releasing apparatus includes a laser and a focusing apparatus including an f-theta lens system (22) that focuses the laser (7) onto predefined points on the ink carrier (2) and wherein a deflection apparatus is provided by which a beam of the laser is alternately guided over two different paths and directed by deflecting mirrors alternately from two different directions and in circumferential direction of the polygonal mirror onto points, staggered by at least the width of the beam up to half a facet length, onto the polygonal mirror.

32. A printing machine according to claim 31 wherein the deflection apparatus comprises a shutter disk, synchronizable with the polygonal mirror, which alternately has metallized surfaces and passage openings.

33. A printing machine according to claim 31 wherein the laser is a polarized laser and the deflection apparatus consists of an electro-optical modulator in combination with at least one polarization filter.

* * * * *